United States Patent [19]

Buck

[11] Patent Number: 4,889,198

[45] Date of Patent: Dec. 26, 1989

[54] DRILLING JAR LATCH

[76] Inventor: David A. Buck, 118 Rue Du Pain, Broussard, La. 70518

[21] Appl. No.: 257,692

[22] Filed: Oct. 14, 1988

[51] Int. Cl.[4] ..... E21B 31/107

[52] U.S. Cl. ..... 175/304; 175/321

[58] Field of Search ..... 175/321, 294, 300, 302, 175/303, 304; 292/256.6

[56] References Cited

U.S. PATENT DOCUMENTS

| | | | |
|---|---|---|---|
| 2,882,018 | 4/1959 | Andrew | 175/304 X |
| 2,962,098 | 11/1960 | Conrad | 175/304 |
| 2,978,048 | 4/1961 | Walker . | |
| 4,376,468 | 3/1983 | Clark | 175/304 |
| 4,646,830 | 3/1987 | Templeton | 175/304 X |
| 4,688,649 | 8/1987 | Buck | 175/299 |
| 4,694,917 | 9/1987 | Heidemann et al. | 175/304 X |

*Primary Examiner*—William P. Neuder

*Attorney, Agent, or Firm*—John D. Jeter

[57] ABSTRACT

A latch for a telescoping drill string jar is confined in an opening in the jar housing and engages the arbor of the jar to prevent telescoping action for normal drilling. The latch has a number of spring bars, each with a latch lug extending into a latch groove in the arbor. The lugs and the groove have beveled engagement surfaces that urge the spring bars radially outward, into clearance provided, when axial forces on the arbor relative to the housing exceed a preselected amount. The end of the spring bars are restrained in a cup with tubular sides extending along the spring bars to limit the length of spring bar allowed to flex radially outward. The length free to flex determines the average axial force required to release the latch. The ratio of the extending sides of the opposed cups determines the ratio of tension or compresive axial forces required to release the latch. The jar fitted with the latch is free to telescope, to cause jarring, when the lugs clear the groove.

3 Claims, 2 Drawing Sheets

DRILLING JAR LATCH

Apparatus of this invention is used in telescoping drill string jars. Drill string jars are used as part of a drill string in current well drilling practice, primarily to loosen stuck pipe, but also to recover parts of drill string lost in the well. Latches retain telescoping jars in the normal drilling configuration for drilling until the latch is released to activate the jar. Drilling jars are well established in the art.

BACKGROUND OF THE INVENTION

Drill string jars, or drilling jars, are installed as part of the drill string in a well and commonly serve as a length of the drill string. At least one jar is commonly placed above that portion of the drill string most likely to get stuck in the well. When the drill string gets stuck below the jar, axial load is applied to the jar in preparation for jarring the stuck portion. The axial load may be in tension or compression if the jar will accept both. The latch is then released (or actuated) to allow the jar to telescope to change length. The length change between the stuck portion of the drill string and the free, and stressed, portion of the drill string imparts a velocity to a rather heavy mass of the drill string. When the telescoping movement runs out, it is stopped suddenly, jarring the stuck portion.

Latches for drilling jars have taken many forms. Some actuate by axial stress in excess of that needed for drilling. Some are released by excess axial stress and another factor such as torque or drilling fluid pressure. Apparatus of this invention is actuated by excess axial stress only. This invention pertains to the latch only and descriptive matter pertaining to details of construction of telescoping jars is for clarity of the latch description.

There are many latches for telescoping jars in the art. Some have provisions for rigsite adjustment of the axial force required for latch release. Complexity of any drill string component is an undesirable factor. Simplicity is always a desired design objective.

Some drill string jars are installed in a particular location in the drill string relative to the drill head and the adjustment is never changed between the jars shop overhaul sequences. Such jars invite simplicity of construction. It is therefore an object of this invention to provide a drilling jar latch of simple design and construction. It is a further object of this invention to provide a drilling jar latch that can be adjusted during assembly by selection of low cost components with dimension choices determining the release forces. It is another object of this invention to provide a drilling jar latch that can be used in tension or compression with the release forces for each independently adjustable by dimension choices of components used in assembly.

These and other objects, advantages, and features of this invention will be apparent to those skilled in the art from a consideration of this specification, including the attached claims and appended drawings.

SUMMARY OF THE INVENTION

A latch for a telescoping drilling jar is retained in an opening in the jar housing to prevent axial movement of the arbor relative to the housing for normal drilling. With a preselected axial force applied to the jar, the latch releases the arbor for axial telescoping movement. The latch has a plurality of spring bars, of some length, distributed about the periphery of the arbor. Each spring bar has a latch lug, generally centered, and extending radially inward into a latch groove in the arbor. Axial force on the arbor urges the lugs radially outward. The spring bars deform radially into a provided clearance and, when the lugs clear the groove, the jar telescopes to apply the jarring force.

The spring bars are restrained at each end in a cylindrical cup. The cups have a depth that provides a sleeve extending along the spring bars to determine how much length of the bar can deform radially. This length determines the spring rate of the bars and, hence, how much axial force is required to release the latch.

The lugs and the groove engage on a bevel, the angle of which influences the release force. The design of the bevel angle and the selection of the cup depth determines the average release force. The jar, in compression, places one end of the spring bars in compression and the jar, in tension, places the other end of the spring bars in compression. The strain deformation of the end of the spring bar in compression causes the cup related to that end to have the principal influence upon the release force then applied. The ratio of depths of the opposed cups influences the ratio of compression versus tension forces on the jar that causes latch release.

DETAILED DESCRIPTION OF DRAWINGS

Figure 1:
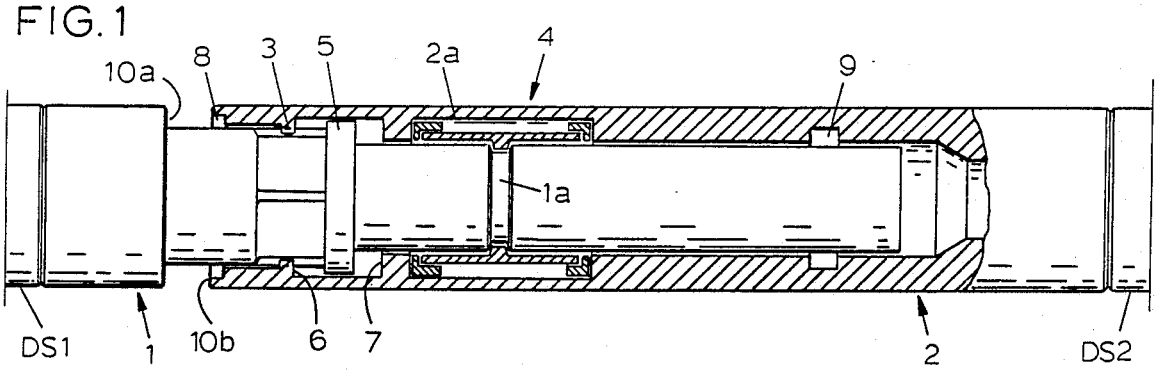
FIG. 1 is a side elevation view of a telescoping drill string jar, partly in section, with the latch of this invention in the usual location.

In the drawings, wherein like features have like captions, FIG. 1 shows a typical drilling jar with a body comprising a housing 2 which telescopingly receives arbor 1, and the latch 4 of this invention which axially secures the arbor in the housing for normal drilling. In use, the drilling jar is connected threadedly between drill string components DS1 and DS2 and functions as a length of a continuing drill string. Assuming DS1 to be the upwardly continuing portion of the drill string, mud is conducted through the jar by channels not shown to the downwardly continuing portions DS2. Upper seal 8 and lower seal 9 provide an enclosure therebetween that contains oil and excludes mud. Spline arrangement 3 provides rotational coupling between housing and arbor.

This invention pertains to latch 4 which is axially confined in opening **2*a* and engages latch groove 1*a* of the arbor to prevent axial movement of the arbor for normal drilling. The latch responds to axial force applied to the arbor, relative to the housing, to axially release the arbor for telescoping jarring action when the axial force exceeds a preselected amount. When the arbor is axially released, the jar shortens if the axial force is compressive and extends when the axial force is in tension. Telescoping movement is limited by limiter flange 5 striking abutment 6 or abutment 7. When telescoped in either direction, reversal of the axial force returns the arbor to the neutral position and the latch automatically engages groove 1***a*.

Some jars limit compressive telescoping by engagement of shoulder 10*a* and abutment 10*b*. The tension telescoping limiting means is sometimes situated on the right end of the arbor by interfering structure not shown.

The spline arrangement 3, particularly on small jars, may be of several noncircular mating forms. If a square or hexagonal rotational coupling is used, the flats may extend to the latch area with grooves 1*a* cut in the flats as shown later herein.

Figure 2:
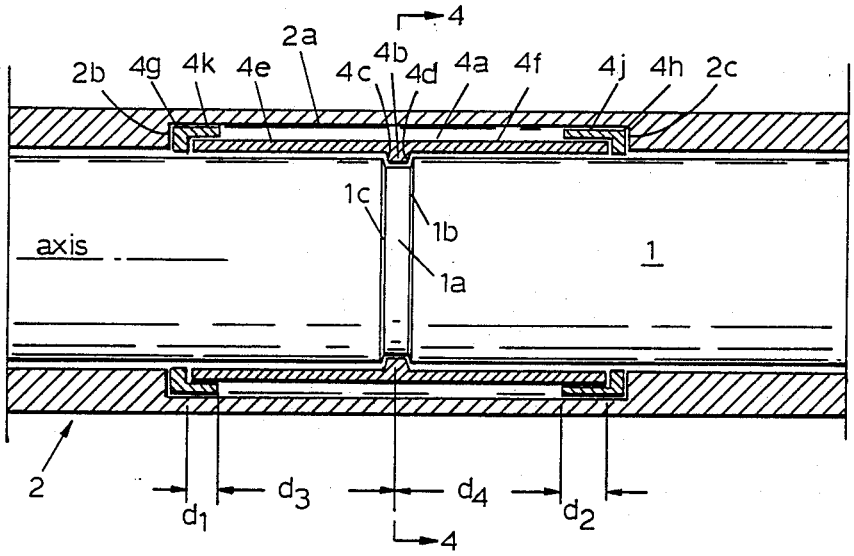
FIG. 2 is a side elevation, somewhat enlarged, mostly in section, of the latch portion of the jar of FIG. 1.

FIG. 2 shows the latch 4 of this invention, rather enlarged. Opening 2*a* has abutments 2*b* and 2*c* to axially confine restraint cups 4*g* and 4*h*. A plurality of spring bars 4*a* are axially confined in the cups. Cup 4*g* has the radial restraint sleeve 4*k* of length $d_1$ that prevents the spring bar from moving radially outward from the axis. Cup 4*h* has radial restraint sleeve extension 4*g* of length $d_2$ that prevents the spring bar from moving radially outward. Strain bar 4*e* is free to strain radially outward along length $d_3$ and strain bar 4*f* is free to strain radially outward along length $d_4$. The spring rate of both strain bars, length $d_3$ and $d_4$, determines the forces available to restore lug 4*b*, when moved radially outward to clear the groove.

During normal drilling, axial forces on the arbor brings bevel 4*c* in contact with bevel 1*c* or bevel 4*d* in contact with bevel 1*b*. The bevel contact produces both axial and radial forces on the lug. Strain bar 4*a* resists movement of the arbor by accepting compression force between the lug and the end of the bars in compression. Forces on the spring bars in compression causes a bending column load described for FIG. 6.

Figure 3:
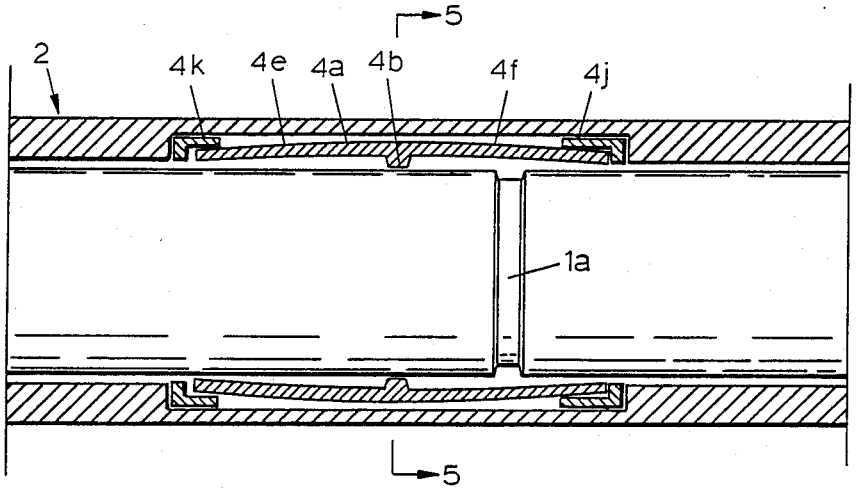
FIG. 3 is a side elevation identical to FIG. 2 but showing the latch actuated to release the jar to allow telescoping to cause jarring.

FIG. 3 shows the arbor moved to the right with spring bars deformed radially to allow lug 4*b* to clear latch groove 1*a*. Groove 1*a* is circular, an optional form, preferred on the larger jars using a large number of spring bars distributed peripherally around the arbor.

Figure 4:
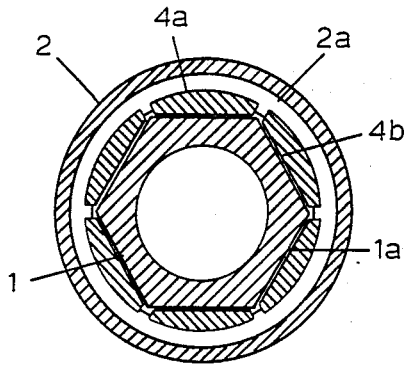
FIG. 4 is a transverse section, taken along line 4—4 of FIG. 2.

FIG. 4 is not quite a true section of FIG. 2 because the shape of the arbor is changed to show a hexagonal shape of groove 1*a*. This groove, then, actually consists of six individual grooves but the principle is the same.

Figure 5:
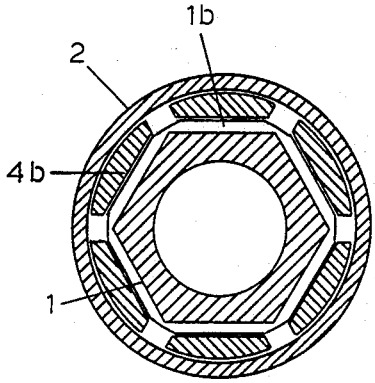
FIG. 5 is identical to FIG. 4 but taken along line 5—5 of FIG. 3 to show released positions.

FIG. 5 shows the arbor moved just enough to cause lugs 4*b* to clear the grooves after bevel 1*b* has urged the lugs out of the grooves.

Figure 6:
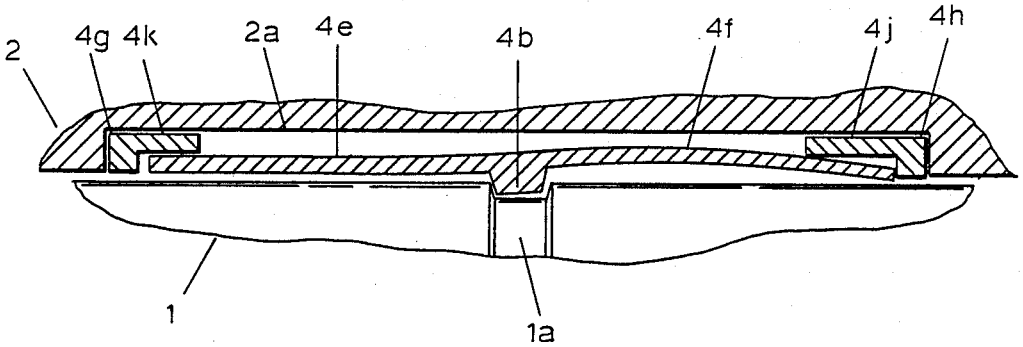
FIG. 6 is a fragmentary side elevation, further enlarged, of a latch element of FIG. 3 showing exaggerated spring bar deformation during latch release.

FIG. 6 shows, considerably exaggerated, the effect of bending column forces on one end of the spring bar. Only one end resists axial force in one axial direction. The arbor is being forced to the right. Lug 4*b* is radially inward of the spring bar 4*f* and produces a bending column load resulting in the distortion shown. Radial restraint sleeve 4*j* experiences more radial force from from bar 4*f* than sleeve 4*k* experiences from bar 4*e*. The length of sleeve 4*j* has more influence on the unlatching force in this direction than does the length of sleeve 4*k*. The jar is being compressed and release force in that direction is primarily influenced by sleeve 4*j*.

If the jar is pulled in tension, the situation is reversed and bar 4*e* will be bowed outward and sleeve 4*k* will have the greater influence.

With a latch groove of preferred practical depth, both sleeves will influence latch release force in both directions but the ratio of sleeve lengths will determine the ratio of axial release forces in opposite directions.

The spring bars are comprised of a generally central latch lug with strain bars extending, from a radially outward position, in each axial direction. The ends of each of the spring bars, or the ends of each of the strain bars, preferably bear on the inner bottoms of the replaceable cups to resist axial displacement caused by forces on the lug.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. An improved latch for use in a telescoping drilling jar arranged to function as length of drill string and having an elongated housing, with an axis, and an arbor, said housing arranged to telescopingly receive said arbor, for limited axial movement therein, said housing having an opening arranged to receive and axially confine a latch situated to engage at least one latch groove in said arbor to axially secure said arbor to said housing for normal drilling and to release said arbor for movement along said axis for telescoping jarring activity, said improved latch comprising:

(a) a plurality of elongated spring bars situated in said opening, each having a length, with a general center, extending some length parallel said axis, disposed peripherally around said arbor and capable of deforming radially outward from said axis in said opening;

(b) two separated, opposed, restraint cups situated in said opening, each cup arranged to axially and radially confine one end of each of said spring bars, said cups having tubular extensions extending some distance along said spring bars toward said center to inhibit radial movement of said spring bars for said distance;

(c) at least one integral latch lug generally centered on each said spring bar extending radially toward said axis and arranged to engage said latch groove;

(d) at least one beveled surface on each of said lugs arranged to engage an opposing beveled surface on said groove such that axial force on said arbor relative to said housing will urge said lugs radially outward from said axis to clear said groove and release said arbor for axial movment relative to said housing for jarring activity.

2. An improved latch for a telescoping drill string jar having an elongated body and a generally central axis, for use as a length of drill string, said body including a housing and an arbor telescopingly received for limited telescoping movement therein, said housing having an opening to receive and axially constrain a latch arranged to engage at least one latch groove in said arbor to axially secure said arbor in said housing for normal drilling, said latch to release said arbor for axial telescoping extension of said body in response to axial tension force greater than a preselected amount and to release said arbor for telescoping contraction of said body in response to compressive axial force greater than a preselected amount, for jarring action, said latch comprising:

(a) a plurality of spring bars of some length situated in said opening, distributed about the periphery of said arbor, each comprising; a latch lug extending some radial distance into said groove, a first strain bar positioned radially outward of said lug and extending a first length in a first axial direction to a first end, a second strain bar radially outward of said lug and extending a second length in the opposite axial direction to a second end;

(b) a first radial restraint sleeve of a preselected first axial dimension situated to extend from said first end said first axial dimension toward said lug and arranged to prevent outward movement of said strain bar for said first axial dimension;

(c) a second radial rstraint sleeve of a preselected second axial dimension situated to extend from said second end said second axial dimension toward said lug and arranged to prevent outward movement of said second strain bar for said second axial dimension;

(d) cam surfaces on said lug arranged to engage said groove such that axial force on said arbor results in radial outward force on said spring bar and axial column force on each of said strain bars in one axial direction; and (e) surface abutment means in said opening arranged to engage said ends to prevent, by compressive force, axial displacement of lug.

3. The improved latch of claim 2 wherein at least one of said restraint sleeves has a flange extending radially inward to provide said surface abutment means.

* * * * *